US006911880B2

(12) United States Patent
Arai et al.

(10) Patent No.: US 6,911,880 B2
(45) Date of Patent: Jun. 28, 2005

(54) TRANSMISSION LINE TYPE NOISE FILTER WITH SMALL SIZE AND SIMPLE STRUCTURE, HAVING EXCELLENT NOISE REMOVING CHARACTERISTIC OVER WIDE BAND INCLUDING HIGH FREQUENCY BAND

(75) Inventors: Satoshi Arai, Sendai (JP); Takayuki Inoi, Sendai (JP); Yoshihiko Saiki, Sendai (JP); Sadamu Toita, Sendai (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 10/458,918

(22) Filed: Jun. 10, 2003

(65) Prior Publication Data

US 2003/0231085 A1 Dec. 18, 2003

(30) Foreign Application Priority Data

Jun. 11, 2002 (JP) ..... 2002-169923

(51) Int. Cl.[7] ..... H03H 7/01
(52) U.S. Cl. ..... 333/181; 333/184; 333/185
(58) Field of Search ..... 333/181–185, 333/34, 204, 247

(56) References Cited

U.S. PATENT DOCUMENTS 4,683,450 A 7/1987 Max et al.
6,331,806 B1 * 12/2001 Shingyoji et al. ..... 333/33
6,473,510 B1 * 10/2002 Marsh ..... 381/94.6
6,624,718 B2 * 9/2003 Mauritz et al. ..... 333/34
6,646,523 B2 * 11/2003 Arai et al. ..... 333/184
2002/0024407 A1 2/2002 Arai et al.

FOREIGN PATENT DOCUMENTS

JP 3-51503 A 5/1991
JP 05-183312 A 7/1993
JP 07-192972 A 7/1995
JP 02002164760 A * 6/2002 ..... H03H/7/01
JP 2002164760 A * 6/2002 ..... H03H/7/01

* cited by examiner

*Primary Examiner*—Seungsook Ham
(74) *Attorney, Agent, or Firm*—Frishauf, Holtz, Goodman & Chick, P.C.

(57) ABSTRACT

A noise filter (1) has a first impedance element (2) having an impedance value Z1, a second impedance element (3) having an impedance value Z2, a third impedance element (4) having an impedance value Z3, a first anode terminal (5), a second anode terminal (6), and a cathode terminal (7). Z1<Z2 and Z1<Z3 are satisfied. Both ends of a central conductor (2*a*) of the first impedance element (2) are connected to a first node (8) and a second node (9), respectively. Both ends of the second impedance element (3) are connected to the first node (8) and the first anode terminal (5), respectively. Both ends of the third impedance element (4) are connected to the second anode terminal (6) and the second node (9), respectively. The central conductor (2*a*) and a cathode conductor (2*b*) of the first impedance element (2) form a transmission line structure having the impedance value Z1. The cathode conductor (2*b*) is connected to the cathode terminal (7).

12 Claims, 6 Drawing Sheets

TRANSMISSION LINE TYPE NOISE FILTER WITH SMALL SIZE AND SIMPLE STRUCTURE, HAVING EXCELLENT NOISE REMOVING CHARACTERISTIC OVER WIDE BAND INCLUDING HIGH FREQUENCY BAND

This application claims priority to prior application JP 2002-169923, the disclosure of which is incorporated herein by reference.

BACKGROUND OF THE INVENTION

The present invention relates to a noise filter that is mounted in an electronic device or electronic equipment for removing noise generated therein.

Digital technologies are important technologies supporting IT (Information Technology) industries. Recently, digital circuit technologies such as LSI (Large Scale Integration) have been used in not only computers and communication-related devices, but also household electric appliances and vehicle equipment.

High-frequency noise currents generated in LSI chips or the like do not stay in the neighborhood of the LSI chips but spread over wide ranges within mounting circuit boards such as printed circuit boards, and are subjected to inductive coupling in signal wiring or ground wiring, thereby leaking from signal cables or the like as electromagnetic waves.

In those circuits each including an analog circuit and a digital circuit, such as a circuit in which part of a conventional analog circuit is replaced with a digital circuit, or a digital circuit having analog input and output, electromagnetic interference from the digital circuit to the analog circuit has been becoming a serious problem.

As a countermeasure therefor, a technique of power supply decoupling is effective in which an LSI chip as a source of generation of high-frequency current is separated from a dc power supply system in terms of high frequencies. Noise filters such as bypass capacitors have been used hitherto as decoupling elements, and the operation principle of the power supply decoupling is simple and clear.

The capacitors as noise filters used in conventional ac circuits form two-terminal lumped constant noise filters, and solid electrolytic capacitors, electric double-layer capacitors, ceramic capacitors or the like are often used therefor.

When carrying out removal of electrical noise in an ac circuit over a wide frequency band, inasmuch as a frequency band that can be dealt with by one capacitor is relatively narrow, different kinds of capacitors, for example, an aluminum electrolytic capacitor, a tantalum capacitor and a ceramic capacitor having different self-resonance frequencies, are provided in the ac circuit.

Conventionally, however, it has been bothersome to select and design a plurality of noise filters that are used for removing electrical noise of a wide frequency band. In addition, there has been a problem that, because of using different kinds of the noise filters, the cost is high, the size is large, and the weight is heavy.

Further, as described above, for dealing with higher-speed and higher-frequency digital circuits, there have been demanded those noise filters that can ensure decoupling over a high frequency band and exhibit low impedances even in the high frequency band.

However, the two-terminal lumped constant noise filters have difficulty in maintaining low impedances up to the high frequency band due to self-resonance phenomena of capacitors, and thus are inferior in performance of removing high-frequency band noise.

Further, the electronic equipment or devices with the LSI chips or the like mounted therein have been required to be further reduced in size, weight and cost. Therefore, the noise filters that are used in those electronic equipment or devices have also been required to be further reduced in size, to be structured more simply, and to be manufactured more easily.

SUMMARY OF THE INVENTION

Therefore, it is an object of the present invention to provide a transmission line type noise filter that is excellent in noise removing characteristic over a wide band including a high frequency band and that has a small size and a simple structure.

A transmission line type noise filter according to the present invention is a transmission line type noise filter connectable between an electrical load component and a power supply for attenuating a coming alternating current while passing a coming direct current, and comprising a first anode terminal connected to the electrical load component; a second anode terminal connected to the power supply; a first impedance element having a transmission line structure; and a second impedance element having an impedance value greater than an impedance value of the first impedance element, and connected between one end of the first impedance element and the first anode terminal, in which the other end of the first impedance element is connected to the second anode terminal.

Another transmission line type noise filter according to the present invention is a transmission line type noise filter connectable between an electrical load component and a power supply for attenuating a coming alternating current while passing a coming direct current, and comprising a first anode terminal connected to the electrical load component; a second anode terminal connected to the power supply; a first impedance element having a transmission line structure; a second impedance element having an impedance value greater than an impedance value of the first impedance element, and connected between one end of the first impedance element and the first anode terminal; and a cathode terminal connected to a fixed potential, in which the other end of the first impedance element is connected to the second anode terminal, the first impedance element comprises a first conductor and a second conductor confronting the first conductor, the transmission line structure is formed in a region where the first conductor and the second conductor are disposed confronting each other, and has a rectangular shape in plan view, and a length of the first conductor in a first direction parallel to a line of the transmission line structure, a length of the first conductor in a second direction perpendicular to the first direction, and an effective thickness are set so that the impedance value of the first impedance element becomes smaller than the impedance value of the second impedance element, one end of the first conductor in the first direction is connected to the second impedance element, while the other end thereof is connected to the second anode terminal, and the second conductor is connected to the cathode terminal.

Other objects, features and advantages of the present invention will become apparent from the following description of this specification.

BRIEF DESCRIPTION OF THE DRAWINGS

FIGS. 2A to 2C are diagrams showing a transmission line type noise filter according to a first preferred embodiment of the present invention, in which FIG. 2A is an exemplary plan view, FIG. 2B is a sectional view taken along line A–A' of FIG. 2A, and FIG. 2C is a sectional view taken along line B–B' of FIG. 2A;

FIGS. 5A to 5C are diagrams showing a transmission line type noise filter according to a third preferred embodiment of the present invention, in which FIG. 5A is an exemplary plan view, FIG. 5B is a sectional view taken along line E–E' of FIG. 5A, and FIG. 5C is an exemplary sectional perspective view showing a structure of one electric double-layer cell included in an electric double-layer capacitor;

DESCRIPTION OF THE PREFERRED EMBODIMENTS

Now, transmission line type noise filters according to preferred embodiments of the present invention will be described hereinbelow with reference to the drawings.

Figure 1:
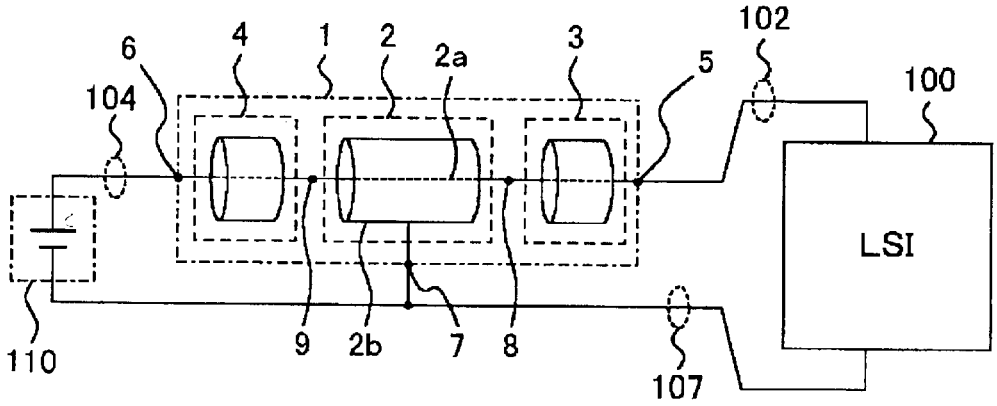
FIG. 1 is an exemplary diagram showing a schematic structure of a preferred embodiment of a transmission line type noise filter of the present invention.

FIG. 1 is an exemplary diagram showing a schematic structure of a preferred embodiment of a transmission line type noise filter of the present invention, and shows the state in which the noise filter of this embodiment is interposed between an electronic component and a power supply that drives the electronic component.

Referring to FIG. 1, a noise filter 1 of this embodiment comprises a first impedance element (filter segment) 2 having an impedance value Z1, a second impedance element (filter segment) 3 having an impedance value Z2, a third impedance element (filter segment) 4 having an impedance value Z3, a first anode terminal 5, a second anode terminal 6, and a cathode terminal 7. The noise filter 1 satisfies Z1<Z2 and Z1<Z3 in a frequency region higher than a predetermined frequency Fm.

The first impedance element 2 comprises a central conductor 2*a* and a cathode conductor 2*b*.

Both ends of the central conductor 2*a* of the first impedance element 2 are connected to a first node 8 and a second node 9, respectively, both ends of the second impedance element 3 are connected to the first node 8 and the first anode terminal 5, respectively, and both ends of the third impedance element 4 are connected to the second anode terminal 6 and the second node 9, respectively.

Further, the cathode conductor 2*b* of the first impedance element 2 is connected to the cathode terminal 7.

The central conductor 2*a* and the cathode conductor 2*b* of the first impedance element 2 form a transmission line structure having the impedance value Z1.

The noise filter 1 has the first anode terminal 5 connected to a high-potential side power input terminal of an electronic component such as an LSI 100 via a first power line 102, the second anode terminal 6 connected to a high-potential side output terminal of a dc power supply 110 via a second power line 104, and the cathode terminal 7 connected to a low-potential side power line (hereinafter referred to as "ground line") providing connection between a low-potential side output terminal of the dc power supply 110 and a low-potential side power input terminal of the LSI 100.

Now, an operation of the transmission line type noise filter of the present invention will be described using an operation of the noise filter 1 as an example.

The LSI 100 causes generation of noise on the first power line 102 following an operation thereof.

The generated noise is transmitted through the first power line 102, but part of it is reflected by the high-impedance second impedance element 3, disposed on the side of the first anode terminal 5, of the noise filter 1 and returned to the side of the LSI 100.

The residual noise invades the inside of the noise filter 1 via the second impedance element 3, but most of it is led to the ground line 107 via the cathode terminal 7 by means of the low-impedance first impedance element 2, bypassing the second power line 104 etc., and thus returned to the LSI 100 likewise.

In this manner, the noise transmitted to the side of the second power line 104 is attenuated to a slight amount.

The foregoing operation is a basic feature of the transmission line type noise filter according to the present invention. However, the present invention may further comprise the third impedance element 4.

The noise that has even passed through the first impedance element 2 and reached the second node 9 is reflected by the high-impedance third impedance element 4 disposed between the second node 9 and the second anode terminal 6 and returned to the first impedance element 2 so as to be further returned from the first impedance element 2 to the side of the LSI 100.

In this manner, the noise transmitted to the side of the second power line 104 is attenuated to an extremely slight amount.

Inasmuch as the present noise filter is of the transmission line type, it is possible to remove noise of a wide frequency band with high accuracy without providing a plurality of noise filters (capacitors) having different self-resonance frequencies as in the conventional technique. That is, it is not necessary to perform a laborsome operation of setting frequency bands to capacitors disposed in an ac circuit for noise removal, and thus the cost can be reduced.

Furthermore, in the noise filter 1 of this embodiment, as described above, the second and third impedance elements 3 and 4 having, in the frequency region higher than the predetermined frequency Fm, the impedance values Z2 and Z3 that are sufficiently higher than the impedance value Z1 of the first impedance element 2, respectively, are added between one end of the low-impedance first impedance element 2 having the transmission line structure and the first anode terminal 5 and between the other end of the first impedance element 2 and the second anode terminal 6, respectively. With this structure, the noise filter 1 can accomplish higher noise removal efficiency as compared with a noise filter formed only by the first impedance element 2.

Further, as will be described later in detail, the second and third impedance elements 3 and 4 can be formed integral with the first impedance element 2. Therefore, the noise filter can be very simple in structure as a whole, thereby enabling reduction in size, weight and cost.

Hereinbelow, description will be given about some more-detailed embodiments of noise filters according to the present invention.

First Embodiment

Figure 2A:
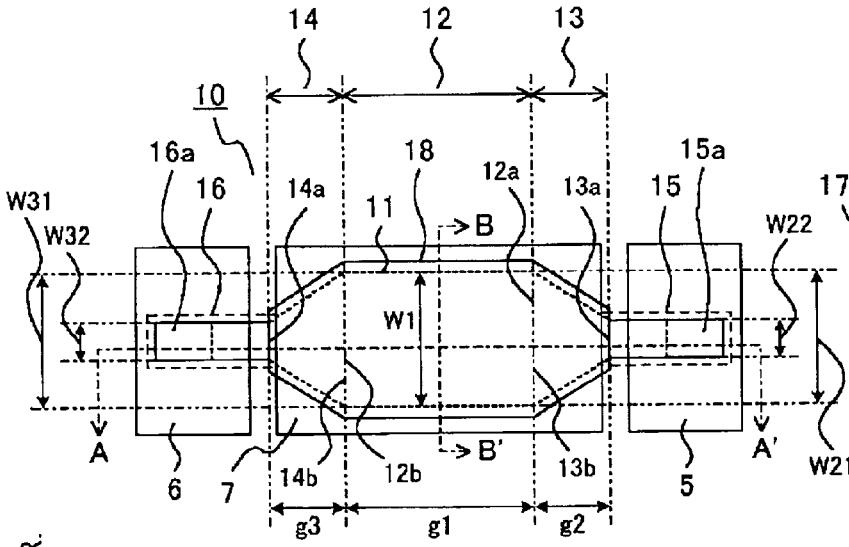
Figure 2C:
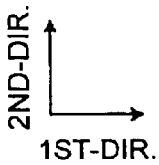
Figure 2C:
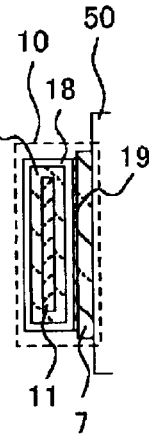
Figure 2B:
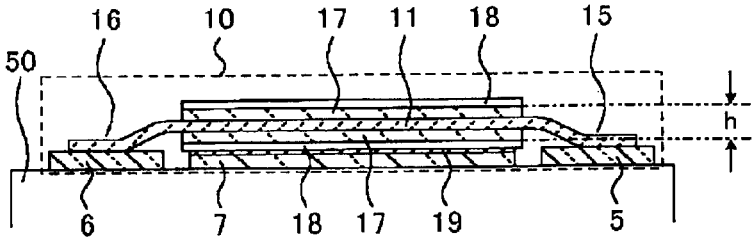

FIGS. 2A to 2C are diagrams showing a first embodiment of the present invention, in which FIG. 2A is an exemplary plan view, FIG. 2B is a sectional view taken along line A–A' of FIG. 2A, and FIG. 2C is a sectional view taken along line B–B' of FIG. 2A.

A noise filter 10 in this embodiment has a structure in which the first impedance element 2, the second impedance element 3 and the third impedance element 4 in FIG. 1 are unified together.

Referring to FIGS. 2A to 2C, the noise filter 10 comprises a metal plate 11 in the form of a substantially flat plate serving as a first conductor, a confronting metal layer 18 serving as a second conductor that confronts the metal plate 11 via a dielectric 17 interposed therebetween, a first anode terminal 5, a second anode terminal 6, and a cathode terminal 7.

A contact portion 15*a* of a first electrode portion 15 and a contact portion 16*a* of a second electrode portion 16 that form both end portions of the metal plate 11 in a longitudinal direction thereof, i.e. in a first direction, are respectively connected to the first anode terminal 5 and the second anode terminal 6 by, for example, welding. The confronting metal layer 18 and the cathode terminal 7 are connected together by means of a conductive adhesive 19. The first anode terminal 5, the second anode terminal 6 and the cathode terminal 7 are provided, for example, on a mounting board 50.

The metal plate 11 has a rectangular region 12 having a rectangular shape in plan view at a central portion thereof in the first direction. The rectangular region 12 has a length g1 in the first direction and a length W1 in a second direction perpendicular to the first direction.

A first trapezoidal region 13 having a trapezoidal shape in plan view is provided between a first one end 12*a* representing one end of the rectangular region 12 in the first direction and the first electrode portion 15, and a second trapezoidal region 14 having a trapezoidal shape in plan view is provided between a first other end 12*b* representing the other end of the rectangular region 12 in the first direction and the second electrode portion 16.

The first trapezoidal region 13 has a length g2 in the first direction. Lengths of the first trapezoidal region 13 in the second direction are such that a second one end 13*a* connected to the first electrode portion 15 has a length W22, and a second other end 13*b* connected to the first one end 12*a* of the rectangular region 12 has a length W21(=W1).

The second trapezoidal region 14 has a length g3 in the first direction. Lengths of the second trapezoidal region 14 in the second direction are such that a third one end 14*a* connected to the second electrode portion 16 has a length W32, and a third other end 14*b* connected to the first other end 12*b* of the rectangular region 12 has a length W31 (=W1).

It is given that W22<W1 and W32<W1. Normally, g1>g2 and g1>g3.

In the foregoing structure, the rectangular region 12 forms a first impedance element (filter segment) having a transmission line structure with the metal plate 11 serving as a central conductor (first conductor) and with the confronting metal layer 18 serving as a cathode conductor (second conductor). The first trapezoidal region 13 forms a second impedance element (filter segment) having a first distributed constant circuit structure with the metal plate 11 serving as a central conductor and with the confronting metal layer 18 serving as a cathode conductor. And the second trapezoidal region 14 forms a third impedance element (filter segment) having a second distributed constant circuit structure with the metal plate 11 serving as a central conductor and with the confronting metal layer 18 serving as a cathode conductor.

As noted above, inasmuch as W22<W1 and W32<W1, a characteristic impedance Z01 of the first impedance element is smaller than each of a characteristic impedance Z02 of the second impedance element and a characteristic impedance Z03 of the third impedance element.

In the noise filter 10 of this embodiment, the first, second and third impedance elements may be formed by a solid electrolytic capacitor, an electric double-layer capacitor, a ceramic capacitor or the like.

Now, description will be given about determination of the structure of the first impedance element having the transmission line structure and removing most of noise.

Figure 3:
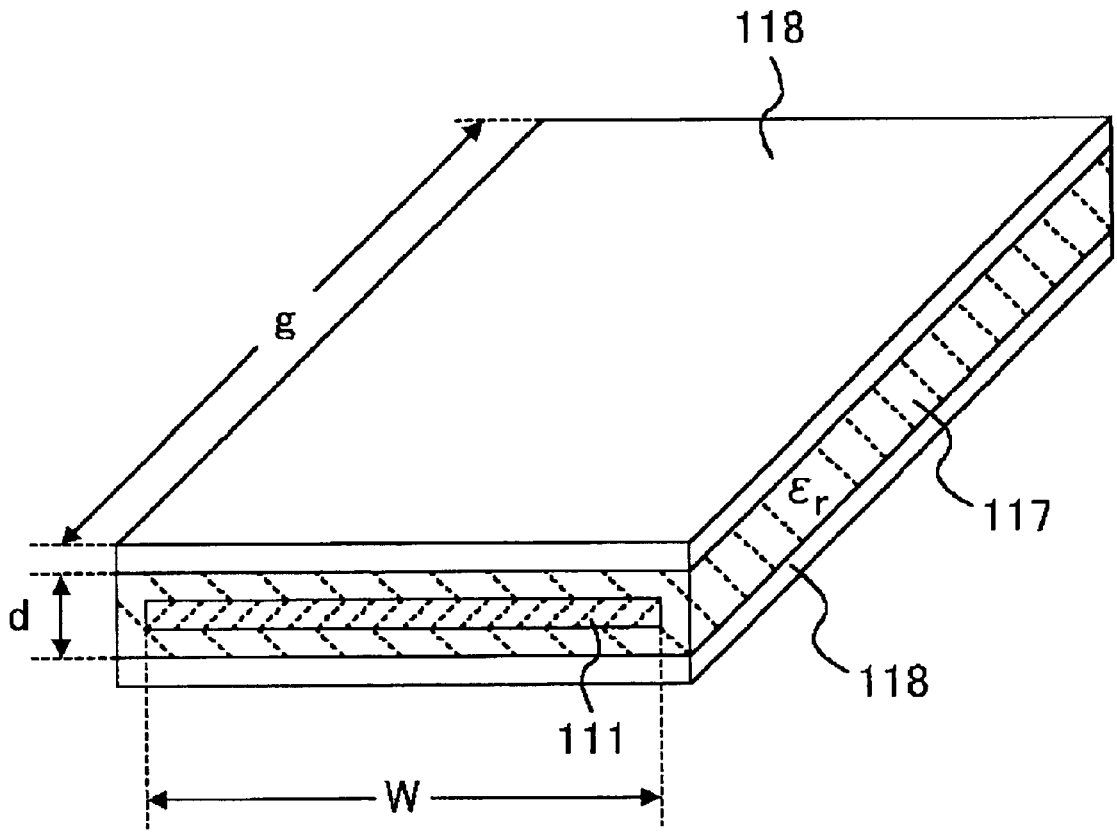
FIG. 3 is a diagram showing a transmission line model of a first impedance element in the transmission line type noise filter of the present invention.

First, in a transmission line model having a structure in which an inside metal plate 111 is sandwiched between a pair of confronting metal layers 118 via a dielectric 117 as shown in FIG. 3, a capacitance C and an inductance L per unit length can be expressed as $$C=4\cdot\epsilon_0\cdot\epsilon_r\cdot W/d$$

$$L=\tfrac{1}{4}\cdot\mu_0\cdot d/W$$

in which $\epsilon_0$ represents a permittivity of free space, $\mu_0$ represents a permeability of free space, and $\epsilon_r$ and d represent a relative permittivity and a thickness of the dielectric, respectively.

Therefore, a characteristic impedance $Z_0$ of this transmission line model is given by $$Z_0=(L/C)^{1/2}=\tfrac{1}{4}\cdot(d/W)\cdot(\mu_0/\epsilon_0\cdot\epsilon_r)^{1/2}.$$

Next, consideration will be given about a case in which the transmission line structure of the first impedance element is formed by an aluminum solid electrolytic capacitor, an electric double-layer capacitor or a ceramic capacitor.

In case of the transmission line structure of the aluminum solid electrolytic capacitor, an oxidized coating film is formed on aluminum whose surface area has been enlarged by etching.

On the other hand, the transmission line structure of the electric double-layer capacitor is formed at an interface between an activated carbon electrode surface and an electrolyte.

Each of them has a complicated shape. Accordingly, for the purpose of facilitating handling thereof, an equivalent relative permittivity is defined from a capacitance per unit length and an effective thickness.

Given that a capacitance per unit length is C, an effective thickness of the transmission line structure is h, and an equivalent relative permittivity is $\epsilon_u$, $$C=4\cdot\epsilon_0\cdot\epsilon_u\cdot W/h$$

therefore $$\epsilon_u=1/(4\cdot\epsilon_0)\cdot C\cdot h/W.$$

Here, in case of the general aluminum solid electrolytic capacitor as described above, a capacitance C per unit length, and an effective thickness h and width W of the transmission line structure (herein, an etched layer formed with an oxidized coating film) become $$C=1.65\times10^{-2}\ (\mathrm{F/m})$$

$$h=1.5\times10^{-4}\ (\mathrm{m})$$

$$W=1.0\times10^{-2}\ (\mathrm{m}).$$

Therefore, given that a permittivity of free space $\epsilon_0$ is $8.85\times10^{-12}$ (F/m), an equivalent relative permittivity $\epsilon_u$ becomes $7.0\times10^{6}$.

Similarly, in case of the general electric double-layer capacitor, a capacitance C per unit length, and an effective thickness h and width W of the transmission line structure (herein, a portion sandwiched between upper and lower collectors) become approximately $$C=3.54\times10^{1}\ (\mathrm{F/m})$$

$$h=1\times10^{-4}\ (\mathrm{m})$$

$$W=1\times10^{-2}\ (\mathrm{m}).$$

Therefore, an equivalent relative permittivity $\epsilon_u$ becomes $1.0\times10^{10}$.

In case of the ceramic capacitor, assuming that the transmission line structure is made of a uniform ceramic material itself, an equivalent relative permittivity $\epsilon_u$ is a relative permittivity itself of the ceramic material and becomes about $8.0\times10^{3}$.

In the foregoing equation of the characteristic impedance, when the equivalent relative permittivity $\epsilon_u$ of each capacitor is used as the relative permittivity $\epsilon_r$ of the dielectric and the effective thickness h is used as the thickness d of the dielectric, the characteristic impedance is given by $$Z_0=\tfrac{1}{4}\cdot(h/W)\cdot(\mu_0/\epsilon_0\cdot\epsilon_u)^{1/2}.$$

The characteristic impedance is preferably 0.1Ω or less for sufficiently removing electrical noise, and the condition for achieving the characteristic impedance of 0.1Ω or less is given by $$W/h>2.5(\mu_0/\epsilon_0\cdot\epsilon_u)^{1/2}.$$

By substituting $8.85\times10^{-12}$ (F/m) for $\epsilon_0$, $1.26\times10^{-6}$(H/m) for $\mu_0$, and the foregoing equivalent relative permittivity of each capacitor for $\epsilon_u$, W/h>0.36 in case of the aluminum solid electrolytic capacitor, W/h>0.009 in case of the electric double-layer capacitor, and W/h>11 in case of the ceramic capacitor.

Further, a wavelength λ(m) in the transmission line structure can be calculated by the following equation when wavelength reduction due to the dielectric is taken into consideration.

$$\lambda=c/(f\cdot\epsilon_r^{1/2})$$

in which c represents the speed of light (=$3.0\times10^{8}$ (m/s)), and f represents a frequency (Hz).

When a noise control frequency range generally required is set to 30 MHz to 1 GHz, a value of wavelength at 30 MHz where the wavelength becomes the longest is, when calculated using the equivalent relative permittivity $\epsilon_u$ as the relative permittivity $\epsilon_r$, 3.8 mm in case of the aluminum solid electrolytic capacitor, 0.1 mm in case of the electric double-layer capacitor, and 112 mm in case of the ceramic capacitor.

Preferably, a length g of the transmission line structure in a longitudinal direction thereof is set to no less than a quarter of a wavelength for achieving sufficient attenuation. Accordingly, when applied to the transmission line structure of each capacitor, electrical noise can be removed over a wide frequency band by setting g>0.95 mm in case of the aluminum solid electrolytic capacitor, g>0.025 mm in case of the electric double-layer capacitor, and g>28 mm in case of the ceramic capacitor.

Next, description will be given about a case in which the first, second and third impedance elements of the noise filter 10 are formed by an aluminum solid electrolytic capacitor.

In this case, aluminum foil is used as the metal plate 11, which has a predetermined thickness and a shape including the rectangular region 12, the first trapezoidal region 13 and the second trapezoidal region 14, and further including the first electrode portion 15 and the second electrode portion 16 at both ends thereof.

Ruggedness is formed by etching on both front and back surfaces of those portions corresponding to the rectangular region 12, the first trapezoidal region 13 and the second trapezoidal region 14, and an oxidized coating film is formed along such front and back surfaces as the dielectric 17.

Further, on surfaces of the oxidized coating film, a solid electrolyte layer such as a conductive high molecular layer, a graphite layer and a silver coating layer are formed in the order named as the confronting metal layer 18, and the silver coating layer and the cathode terminal 7 are bonded together using the conductive adhesive 19 such as silver paste.

The shape of the rectangular region 12 may be set depending on a desired characteristic thereof based on the foregoing structure determining principle.

Second Embodiment

Figure 4:
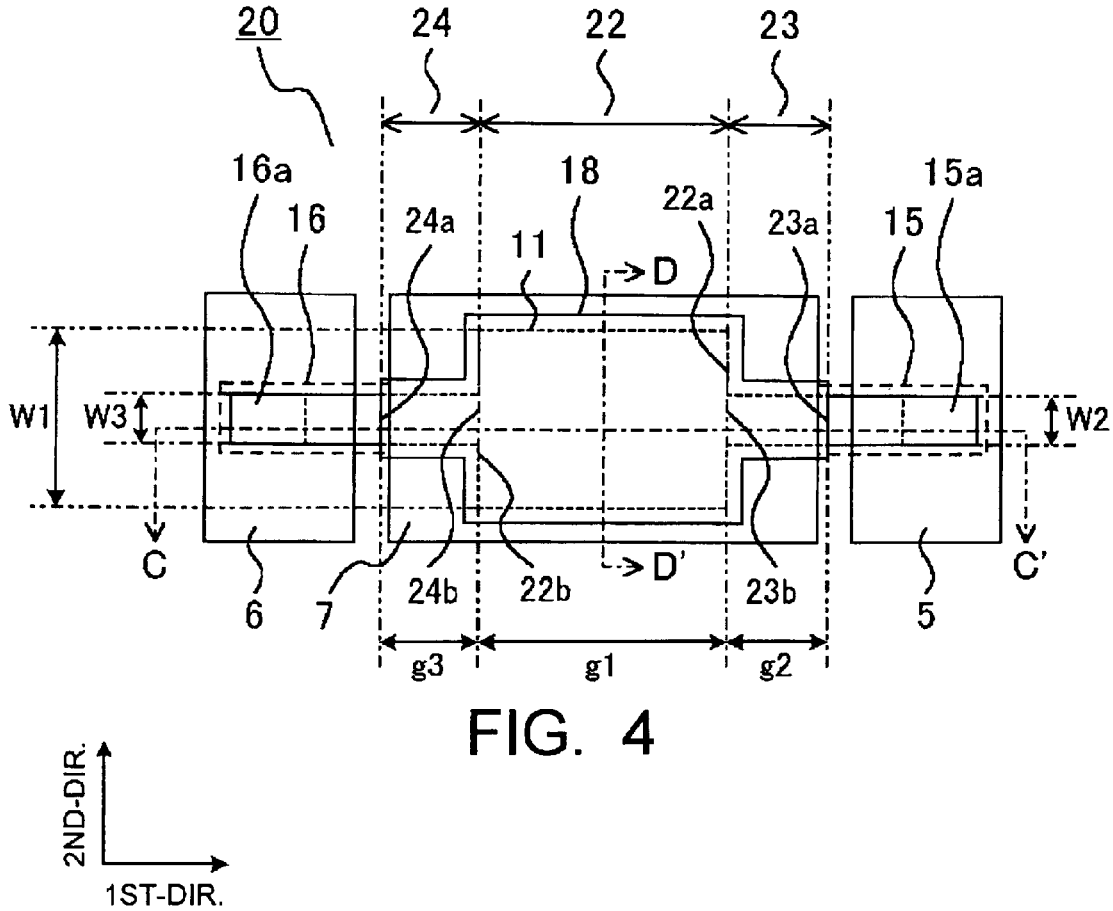
FIG. 4 is an exemplary plan view showing a transmission line type noise filter according to a second preferred embodiment of the present invention.

FIG. 4 is an exemplary plan view showing a structure of a second embodiment of the present invention. Although a sectional view taken along line C–C' of FIG. 4 and a sectional view taken along line D–D' of FIG. 4 are not given, those figures are the same as FIGS. 2B and 2C, respectively.

In the structure of this embodiment, only a metal plate 11 and a confronting metal layer 18 partly differ in shape as compared with the foregoing first embodiment. Accordingly, only such different portions will be described hereinbelow.

In a noise filter 20 of this embodiment, the metal plate 11 has a first rectangular region 22 having a rectangular shape in plan view at a central portion thereof in the first direction. A second rectangular region 23 having a rectangular shape in plan view is provided between a first one end 22*a* representing one end of the first rectangular region 22 in the first direction and a first electrode portion 15, and a third rectangular region 24 having a rectangular shape in plan view is provided between a first other end 22*b* representing the other end of the first rectangular region 22 in the first direction and a second electrode portion 16.

The first rectangular region 22 has a length g1 in the first direction and a length W1 in the second direction.

The second rectangular region 23 has a length g2 in the first direction and a length W2 (<W1) in the second direction. A second one end 23*a* and a second other end 23*b* in the first direction of the second rectangular region 23 are connected to the first electrode portion 15 and the first one end 22*a* of the first rectangular region 22, respectively.

The third rectangular region 24 has a length g3 in the first direction and a length W3 (<W1) in the second direction. A third one end 24*a* and a third other end 24*b* in the first direction of the third rectangular region 24 are connected to the second electrode portion 16 and the first other end 22*b* of the first rectangular region 22, respectively.

Also in this embodiment, the shape of the first rectangular region 22 may be set depending on a desired characteristic thereof based on the foregoing structure determining principle.

Third Embodiment

Figure 5A:
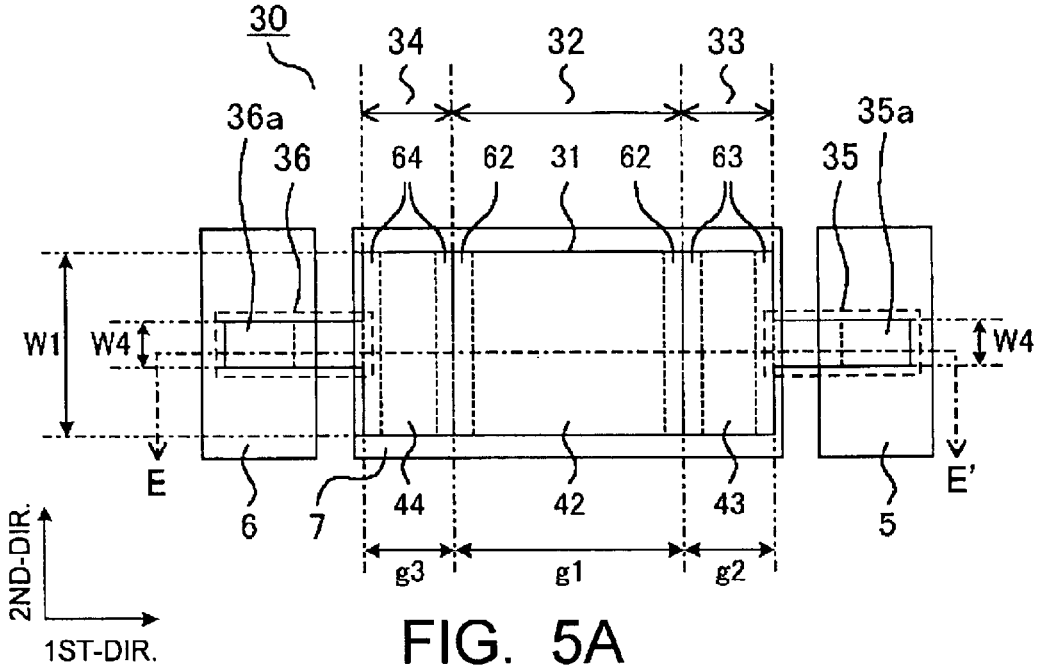
Figure 5B:
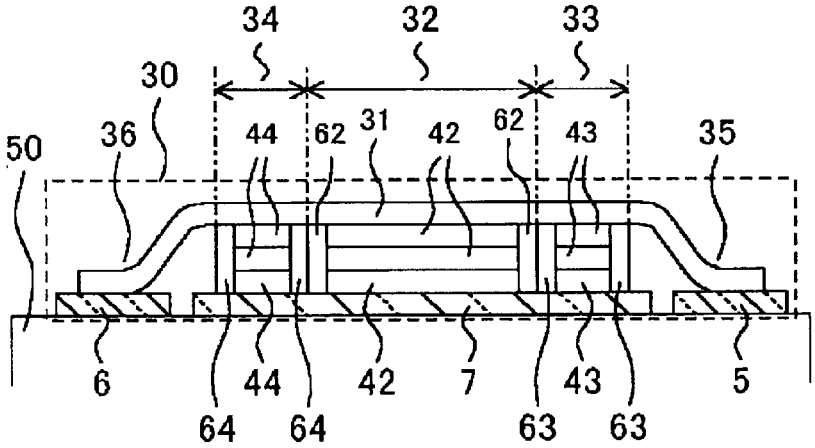
Figure 5C:
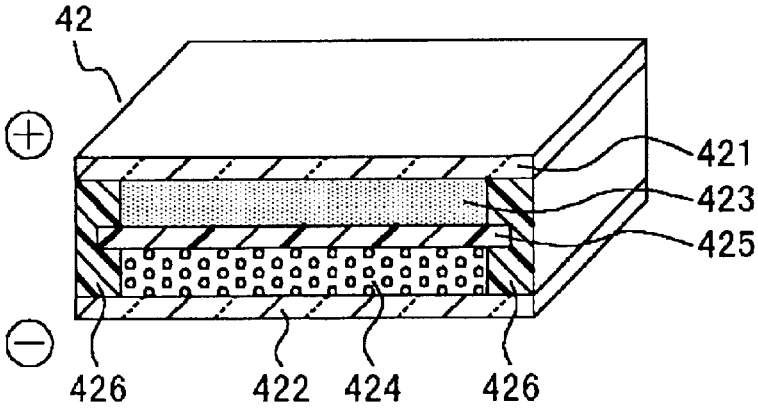

FIGS. 5A to 5C are diagrams showing a structure of a third embodiment of the present invention, in which FIG. 5A is an exemplary plan view, FIG. 5B is a sectional view taken along line E–E' of FIG. 5A, and FIG. 5C is an exemplary sectional perspective view showing a structure of one electric double-layer cell included in an electric double-layer capacitor.

As shown in FIGS. 5A and 5B, in a noise filter 30 of this embodiment, the first, second and third impedance elements are formed by electric double-layer capacitors, respectively.

As the first, second and third impedance elements, a first capacitance portion 32, a second capacitance portion 33 and a third capacitance portion 34 each having a rectangular shape in plan view are used, respectively.

An anode side and a cathode side of each of the first, second and third capacitance portions 32, 33 and 34 are connected to a metal plate 31 and a cathode terminal 7, respectively.

A first electrode portion 35 and a second electrode portion 36 forming both end portions of the metal plate 31 in the first direction are respectively connected to a first anode terminal 5 and a second anode terminal 6.

Lengths g1, g2 and g3 of the first, second and third capacitance portions 32, 33 and 34 in the first direction satisfy g1>g2 and g1>g3.

In the noise filter 30, each capacitance portion forming a transmission line structure or a distributed constant circuit structure of the corresponding impedance element has a structure in which a plurality of electric double-layer cells are stacked within an insulating portion, so that the withstand voltage can be further increased.

Specifically, the first capacitance portion 32 forming the transmission line structure of the first impedance element has a structure in which a plurality of first electric double-layer cells 42 are stacked within an insulating portion 62. The second capacitance portion 33 forming the distributed constant circuit structure of the second impedance element has a structure in which a plurality of second electric double-layer cells 43 are stacked within an insulating portion 63. Further, the third capacitance portion 34 forming the distributed constant circuit structure of the third impedance element has a structure in which a plurality of third electric double-layer cells 44 are stacked within an insulating portion 64. This makes it possible to further increase the withstand voltage of the noise filter 30.

FIG. 5C is a sectional perspective view showing a schematic structure of an electric double-layer cell, using the first electric double-layer cell 42 as an example.

Referring to FIG. 5C, in the first electric double-layer cell 42, a pair of gaskets 426 are arranged in the first direction and collectors 421 and 422 disposed on upper ad lower sides of the gaskets 426 form an anode and a cathode, respectively. An electrolyte 423 contacting the collector 421 and an activated carbon electrode 424 contacting the collector 422 are provided so as to sandwich therebetween a separator 425 through which the electrolyte 423 is passable.

A structure of each of the second electric double-layer cell 43 and the third electric double-layer cell 44 is the same as the structure of the first electric double-layer cell 42, and thus illustration and explanation thereof are omitted herein.

In the noise filter 30, the shape in plan view of the second capacitance portion 33 or the third capacitance portion 34 may be the same as that of the portion corresponding to the second or third impedance element in the noise filter 10 or 20.

As described above, in the transmission line type noise filter of the present invention, between one end of the low-impedance first impedance element having the transmission line structure and the first anode terminal, and between the other end of the first impedance element and the second anode terminal, there are added the second and third impedance elements, respectively, that have the impedance values Z2 and Z3 sufficiently higher than the impedance value Z1 of the first impedance element. This makes it possible to realize the noise removal efficiency higher than that realized by a noise filter formed only by the first impedance element.

The present invention is not limited to the foregoing embodiments, but various changes may be made within a range of the gist thereof. For example, the second and third impedance elements are provided at both ends of the first impedance element in the foregoing embodiments, but it may also be configured that only one of the second and third impedance elements is provided.

Further, as the second and third impedance elements, inductance elements may be used instead of the capacitance elements.

Further, the first to third impedance elements may be formed individually rather than formed integral with each other and then assembled together, as long as the relationship among impedance values of the respective elements is satisfied, and further, a dc resistance between the first anode terminal and the second anode terminal is set to be sufficiently small (normally, 10 mΩ or less).

Figure 6A:
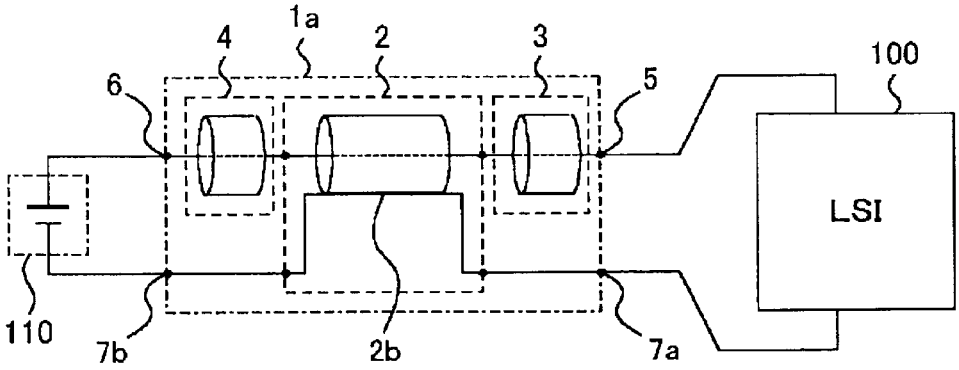
FIG. 6A is an exemplary diagram showing one example in which a transmission line type noise filter of the present invention has a four-terminal structure.

In the foregoing embodiments, the description has been given about the three-terminal structure having the first anode terminal, the second anode terminal and the cathode terminal. However, as shown in FIG. 6A, a four-terminal structure may be employed. Specifically, a first anode terminal 5 and a first cathode terminal 7*a* may be provided at one end of a noise filter 1*a*, while a second anode terminal 6 and a second cathode terminal 7*b* may be provided at the other end of the noise filter 1*a*.

In this event, at least a cathode conductor 2*b* of a first impedance element 2 is connected to the first cathode terminal 7*a* and the second cathode terminal 7*b*, and a dc resistance between the first cathode terminal 7*a* and the second cathode terminal 7*b* is set to be sufficiently small (normally, 10 mΩ or less).

Figure 6B:
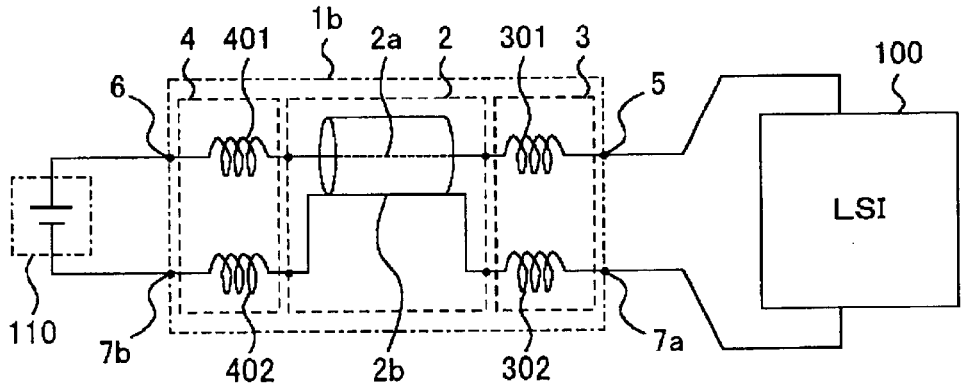
FIG. 6B is an exemplary diagram showing another example in which a transmission line type noise filter of the present invention has a four-terminal structure.

Further, like a noise filter 1*b* of FIG. 6B having another four-terminal structure, it may be configured that an inductance element 301 and an inductance element 401 are connected between one end of a central conductor 2*a* of a first impedance element 2 and a first anode terminal 5 and between the other end of the central conductor 2*a* and a second anode terminal 6, respectively, and further, an inductance element 302 and an inductance element 402 are connected between one end of a cathode conductor 2*b* of the first impedance element 2 and a first cathode terminal 7*a* and between the other end of the cathode conductor 2*b* and a second cathode terminal 7*b*, respectively.

In this case, the inductance element 301 and the inductance element 302 serve as the second impedance element, while the inductance element 401 and the inductance element 402 serve as the third impedance element.

Further, the description has been given about the aluminum solid electrolytic capacitor as a solid electrolytic capacitor, but a tantalum solid electrolytic capacitor may be used instead of it.

In this case, referring to FIGS. 2A to 2C, a tantalum plate having a predetermined thickness and shape is used as a metal plate 11, and tantalum powder is press-molded on both front and back surfaces of those portions corresponding to a rectangular region 12, a first trapezoidal region 13 and a second trapezoidal region 14, then sintered to form a tantalum sintered body, and then a tantalum oxide coating film is formed along surfaces of the tantalum sintered body as a dielectric 17. Further, on surfaces of the tantalum oxide coating film, a solid electrolyte layer such as a conductive high molecular layer, a graphite layer and a silver coating layer are formed in the order named as a confronting metal layer 18, and the silver coating layer and a cathode terminal 7 are bonded together using a conductive adhesive 19 such as silver paste.

The tantalum sintered body may also be formed by forming a green sheet, from slurry including tantalum powder, having a predetermined thickness and a shape that covers the rectangular region 12, the first trapezoidal region 13 and the second trapezoidal region 14 of the metal plate 11, winding the green sheet so as to sandwich the rectangular region 12, the first trapezoidal region 13 and the second trapezoidal region 14 while exposing a first electrode portion 15 and a second electrode portion 16 at both ends of the metal plate 11, and sintering them.

While the present invention has thus far been described in conjunction with several embodiments thereof, it will readily be possible for those skilled in the art to put the present invention into practice in various other manners. For example, the noise filter according to the present invention can be connected to the LSI and packaged with the LSI in a common package so that an LSI chip having a noise filter is produced.

What is claimed is:

1. A transmission line type noise filter connectable between an electrical load component and a power supply for attenuating an alternating current while passing a direct current, said transmission line noise filter comprising:

a first electrode terminal connected to the electrical load component;

a second electrode terminal connected to the power supply;

a third electrode terminal connected to a fixed potential; and first, second, and third distributed constant transmission line type filter segments, each of which includes a first metal conductor comprising a plate, a second metal conductor opposed to the first metal conductor, and a dielectric layer which is made of an oxide of the first metal conductor and which is sandwiched between the first metal conductor and the second metal conductor;

wherein the second filter segment and third filter segment each have a greater impedance than the first filter segment; and wherein the first, the second, and the third filter segments are cascaded such that:

the first metal conductor of the first filter segment is electrically connected to the first metal conductor of the second filter segment and to the first metal conductor of the third filter segment;

the first metal conductor of the second filter segment is electrically connected to the first electrode terminal;

the first metal conductor of the third filter segment is electrically connected to the second electrode terminal; and the second metal conductor of each of the first, the second, and the third filter segments is electrically connected to the third electrode terminal.

2. The transmission line type noise filter according to claim 1, wherein the first, the second, and the third filter segments are integrated.

3. The transmission line type noise filter according to claim 2, wherein the first metal conductor and the second metal conductor of the first filter segment are rectangular.

4. The transmission line type noise filter according to claim 3, wherein the first metal conductor and the second metal conductor of both the second filter segment and the third filter segment are trapezoidal.

5. The transmission line type noise filter according to claim 3, wherein the first metal conductor and the second metal conductor of both the second filter segment and the third filter segment are rectangular and smaller than the first metal conductor and the second metal conductor of the first filter segment in a width direction thereof.

6. The transmission line type noise filter according to claim 3, wherein the first filter segment has a length which is not less than one fourth of a wavelength of high-frequency current generated from the electrical load component.

7. The transmission line type noise filter according to claim 3, wherein a characteristic impedance of the first filter segment is not more than 0.1 ohm.

8. The transmission line type noise filter according to claim 3, wherein the first filter segment comprises a solid electrolytic capacitor.

9. The transmission line type noise filter according to claim 4, wherein the solid electrolytic capacitor comprises an aluminum solid state capacitor.

10. A transmission line type noise filter according to claim 8, wherein the solid electrolytic capacitor comprises a tantalum solid state capacitor.

11. A transmission line type noise filter connectable between an electrical load component and a power supply for attenuating an alternating current while passing a direct current, said transmission line noise filter comprising:

a first electrode terminal connected to the electrical load component;

a second electrode terminal connected to the power supply;

a third electrode terminal connected to a fixed potential; and first, second, and third distributed constant transmission line type filter segments, each of which includes a first metal conductor comprising a plate, a second metal conductor opposed to the first metal conductor, and an electric double-layer capacitor sandwiched between the first metal conductor and the second metal conductor;

wherein the second filter segment and third filter segment each have a greater impedance than the first filter segment; and wherein the first, the second, and the third filter segments are cascaded such that:

the first metal conductor of the first filter segment is electrically connected to the first metal conductor of the second filter segment and to the first metal conductor of the third filter segment;

the first metal conductor of the second filter segment is electrically connected to the first electrode terminal;

the first metal conductor of the third filter segment is electrically connected to the second electrode terminal; and the second metal conductor of each of the first, the second, and the third filter segments is electrically connected to the third electrode terminal.

12. The transmission line type noise filter according to claim 11, wherein the electric double-layer capacitor of each of the first, second and third filter segments comprises a plurality of electric double-layer cells stacked within an insulating portion.

* * * * *

UNITED STATES PATENT AND TRADEMARK OFFICE

CERTIFICATE OF CORRECTION

PATENT NO. : 6,911,880 B2
APPLICATION NO. : 10/458918
DATED : June 28, 2005
INVENTOR(S) : Satoshi Arai et al.

It is certified that error appears in the above-identified patent and that said Letters Patent is hereby corrected as shown below:

Column 12, line 42 (claim 9, line 2), change “4” to --8--.

Signed and Sealed this

Twelfth Day of September, 2006

JON W. DUDAS
*Director of the United States Patent and Trademark Office*